US008434902B2

(12) United States Patent
Velazquez

(10) Patent No.: US 8,434,902 B2
(45) Date of Patent: May 7, 2013

(54) MODULAR LIGHTING FIXTURE SYSTEM

(75) Inventor: Toby Velazquez, Yorba Linda, CA (US)

(73) Assignee: American DJ Supply, Inc., Los Angeles, CA (US)

( * ) Notice: Subject to any disclaimer, the term of this patent is extended or adjusted under 35 U.S.C. 154(b) by 8 days.

(21) Appl. No.: 13/061,700

(22) PCT Filed: Sep. 2, 2009

(86) PCT No.: PCT/US2009/055788

§ 371 (c)(1),
(2), (4) Date: Mar. 1, 2011

(87) PCT Pub. No.: WO2010/028091

PCT Pub. Date: Mar. 11, 2010

(65) Prior Publication Data

US 2011/0164421 A1 Jul. 7, 2011

Related U.S. Application Data

(60) Provisional application No. 61/093,684, filed on Sep. 2, 2008.

(51) Int. Cl.
*F21V 21/005* (2006.01)

(52) U.S. Cl.
USPC ..... 362/249.11; 362/249.07

(58) Field of Classification Search ..... 362/219, 362/225, 223, 217, 249.07, 249.02, 249.11, 362/249, 806, 812
See application file for complete search history.

(56) References Cited

U.S. PATENT DOCUMENTS

| | | | | |
|---|---|---|---|---|
| 6,517,216 | B1 | 2/2003 | Cercone et al. | |
| 6,984,055 | B2 | 1/2006 | McCarthy et al. | |
| 7,282,728 | B2 | 10/2007 | Culbert | |
| 7,293,895 | B2 | 11/2007 | Grossman et al. | |
| 7,380,957 | B2 | 6/2008 | Lanczy | |
| 2006/0215398 | A1 * | 9/2006 | Farmer et al. | 362/227 |

OTHER PUBLICATIONS

International Search Report and Written Opinion dated Oct. 22, 2009 for International Application No. PCT/US2009/055788 from United States Patent and Trademark Office, pp. 1-13, Virginia, United States.
International Preliminary Report on Patentability and Written Opinion dated Mar. 17, 2011 for International Application No. PCT/US2009/055788 from the International Bureau of WIPO, pp. 1-8, Geneva, Switzerland.

* cited by examiner

*Primary Examiner* — Anh Mai
*Assistant Examiner* — Elmito Breval
(74) *Attorney, Agent, or Firm* — Kenneth L. Sherman, Esq.; Michael Zarrabian, Esq.; Sherman & Zarrabian LLP

(57) ABSTRACT

A modular lighting fixture system includes plural modular lighting segments, each modular lighting segment including a mating system for mechanically connecting the modular lighting segment to another modular lighting segment. The modular lighting segments fit together to create different shapes and designs, forming a larger overall fixture system.

29 Claims, 14 Drawing Sheets

MEGA PIXEL MENU/CHANNEL

LED DISPLAY MENU

| | | | |
|---|---|---|---|
| DMX Address setting | Manual - Auto | Manual setting 1 ~ 512 | show DMX address = XXX |
| Channel mode | Channel mode 28-24-16-10-7-4-3 | | |
| Show mode | Show mode 0 Random mode | | Show X |
| | Show mode Speed 1-2-3-4-5-6-7-8 | | |
| | Auto fade | | |
| Sound mode | Sound mode ON - OFF | | |
| Blackout mode | Blackout mode Yes - No | | |
| LED mode | LED mode ON - OFF | | |
| Color mode | Color1-9 | | |
| | Red Color Mixing 0-255 | | |
| | Green Color Mixing 0-255 | | |
| | Blue Color Mixing 0-255 | | |
| Information | Software version ver X | | |
| Fixture Time | Fixture hours 0 ~ 9999 | | |
| Display Inversion | Display Inversion ldsp-dspl | | |

UC3 function

| | | | | |
|---|---|---|---|---|
| Blackout | To blackout all fixture | | | |
| Function | Strobe<br>1.Synchronous strobe in white<br>2.Synchronous strobe in rainbow<br>3.Synchronous sound in white<br>4.Synchronous sound in rainbow | Select 9 Colors<br>1.White<br>2.Red<br>3.Green<br>4.Orange<br>5.Purple<br>6.Yellow<br>7.Cyen<br>8.Mangenta<br>9.Blue | Select 9 Show modes<br>1. Show 1<br>2. Show 2<br>3. Show 3<br>4. Show 4<br>5. Show 5<br>6. Show 6<br>7. Show 7<br>8. Show 8<br>9. Auto fade | Setting speed<br>1.Slow speed<br>2.Middle speed<br>3.Fast speed |
| Mode | Sound (LED OFF) | Latch (LED on) | Chase (LED blink) | Speed (LED Fast blink) |

FIG. 12

DMX 512 Configuration

| 3ch Mode | 4ch Mode | 7ch Mode | 10ch Mode | 16ch Mode | 24ch Mode | 28ch Mode | Functions |
|---|---|---|---|---|---|---|---|
| 1 | 1 | 1 | 1 | 1 | 1 | 1 | Red |
| 2 | 2 | 2 | 2 | 2 | 2 | 2 | Green |
| 3 | 3 | 3 | 3 | 3 | 3 | 3 | Blue |
| | | | 4 | 4 | 4 | 4 | Red |
| | | | 5 | 5 | 5 | 5 | Green |
| | | | 6 | 6 | 6 | 6 | Blue |
| | | | | 7 | 7 | 7 | Red |
| | | | | 8 | 8 | 8 | Green |
| | | | | 9 | 9 | 9 | Blue |
| | | | | 10 | 10 | 10 | Red |
| | | | | 11 | 11 | 11 | Green |
| | | | | 12 | 12 | 12 | Blue |
| | | | | | 13 | 13 | Red |
| | | | | | 14 | 14 | Green |
| | | | | | 15 | 15 | Blue |
| | | | | | 16 | 16 | Red |
| | | | | | 17 | 17 | Green |
| | | | | | 18 | 18 | Blue |
| | | | | | 19 | 19 | Red |
| | | | | | 20 | 20 | Green |
| | | | | | 21 | 21 | Blue |
| | | | | | 22 | 22 | Red |
| | | | | | 23 | 23 | Green |
| | | | | | 24 | 24 | Blue |
| | | 4 | 7 | 13 | | 25 | Marcos/Program |
| | | 5 | 8 | 14 | | 26 | RGB Mix/Color Fade Speed Marco Speed/Sound |
| | | 6 | 9 | 15 | | 27 | Strobe |
| | 4 | 7 | 10 | 16 | | 28 | Master Dimmer |

FIG. 13 (Cont.)

MODULAR LIGHTING FIXTURE SYSTEM

RELATED APPLICATION

This application is a national stage application under 35 U.S.C. section 371 of PCT/US2009/055788 filed Sep. 2, 2009 which, claims priority from U.S. Provisional Patent Application Ser. No. 61/093,684 filed Sep. 2, 2008. Both applications, PCT/US2009/055788 and U.S. Ser. No. 61/093,684, are incorporated herein by reference in their entirety.

FIELD OF THE INVENTION

The present invention relates generally to lighting fixtures and more particularly to modular lighting fixtures.

BACKGROUND OF THE INVENTION

Lighting fixtures are used for illuminating environments such as indoor spaces. A typical lighting fixture comprises a housing including a socket for receiving a lighting element such as a light bulb, wherein the socket provides electrical power to the lighting element. Typically each lighting fixture is independently installed on a support or mounting surface and coupled to an electrical power source for powering the lighting elements.

BRIEF SUMMARY OF THE INVENTION

In one embodiment the present invention provides a lighting fixture, comprising a modular lighting segment including a mating system for mechanically connecting the modular lighting segment to another modular lighting segment, wherein the modular lighting segments fit together to create different shapes and designs, forming a larger overall fixture system. The modular lighting segment further includes a lighting source comprising a lighting element capable of being electrically powered.

In another embodiment, the present invention provides a modular lighting fixture system comprising plural modular lighting segments, each modular lighting segment including a mating system for mechanically connecting the modular lighting segment to another modular lighting segment. The modular lighting segments fit together to create different shapes and designs, forming a larger overall fixture system.

Each modular segment may further include controller cable and electrical power connections allowing electrical power to be provided to each lighting element. The modular lighting segments may be controlled, individually or in groups, from a single external controller.

The mating system may include an electrical docking port for each modular lighting segment, for electrically coupling two modular lighting segments. A modular lighting segment may include a mounting bracket which allows the modular lighting segment to be affixed to a supporting surface or structure. Each modular lighting segment may have one of a plurality of shapes and can connect with at least one other modular lighting segment, for creating a larger overall controlled fixture system in a type of lighting erector set.

The modular lighting segments may comprise at least one of: essentially curved lighting segment shapes and straight lighting segment shapes. The modular lighting segments can be connected to form at least one of: circles, arches, ovals, and "S shaped" configurations, as an overall controlled fixture system.

The modular lighting segments may utilize said mating systems for mechanically connecting together, each mating system comprising a flange mounted on each end of a modular lighting segment, the flanges having through holes for inserting screw mounts, such that the screw mounts can be tightened to hold the flanges together, and thereby the modular lighting segments, stably in place. The screw mounts may be removed to reconfigure the mechanical mating of the modular lighting segments and thereby the overall shape of the fixture.

In another embodiment the present invention provides a method of forming a lighting fixture system, comprising providing plural modular lighting segments, each modular lighting segment including a mating system for mechanically connecting the modular lighting segment to another modular lighting segment, and fitting the modular lighting segments together to create different shapes and designs, forming a larger overall fixture system.

In another embodiment the present invention provides a lighting fixture, comprising a modular lighting segment including a mating system for mechanically connecting the modular lighting segment to another modular lighting segment, wherein the modular lighting segments fit together to create different shapes and designs, forming a larger overall fixture system. The modular lighting segment further including a lighting source comprising a lighting element capable of being electrically powered.

These and other features, aspects and advantages of the present invention will become understood with reference to the following description, appended claims and accompanying figures.

BRIEF DESCRIPTION OF THE DRAWINGS

FIG. 12 shows an example LED display menu and function for controlling the lighting elements.

DETAILED DESCRIPTION OF THE INVENTION

Figure 1:
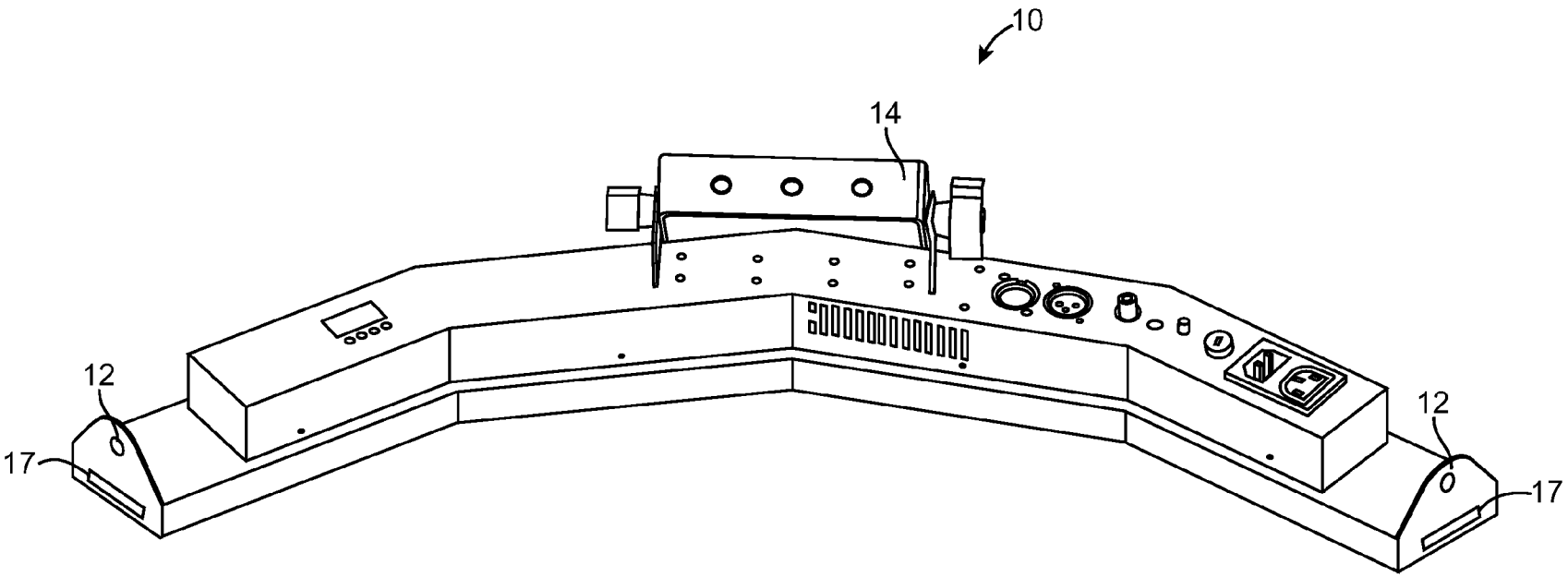
FIG. 1 shows a perspective view of the underside of a lighting segment, according to an embodiment of the invention.
Figure 2:
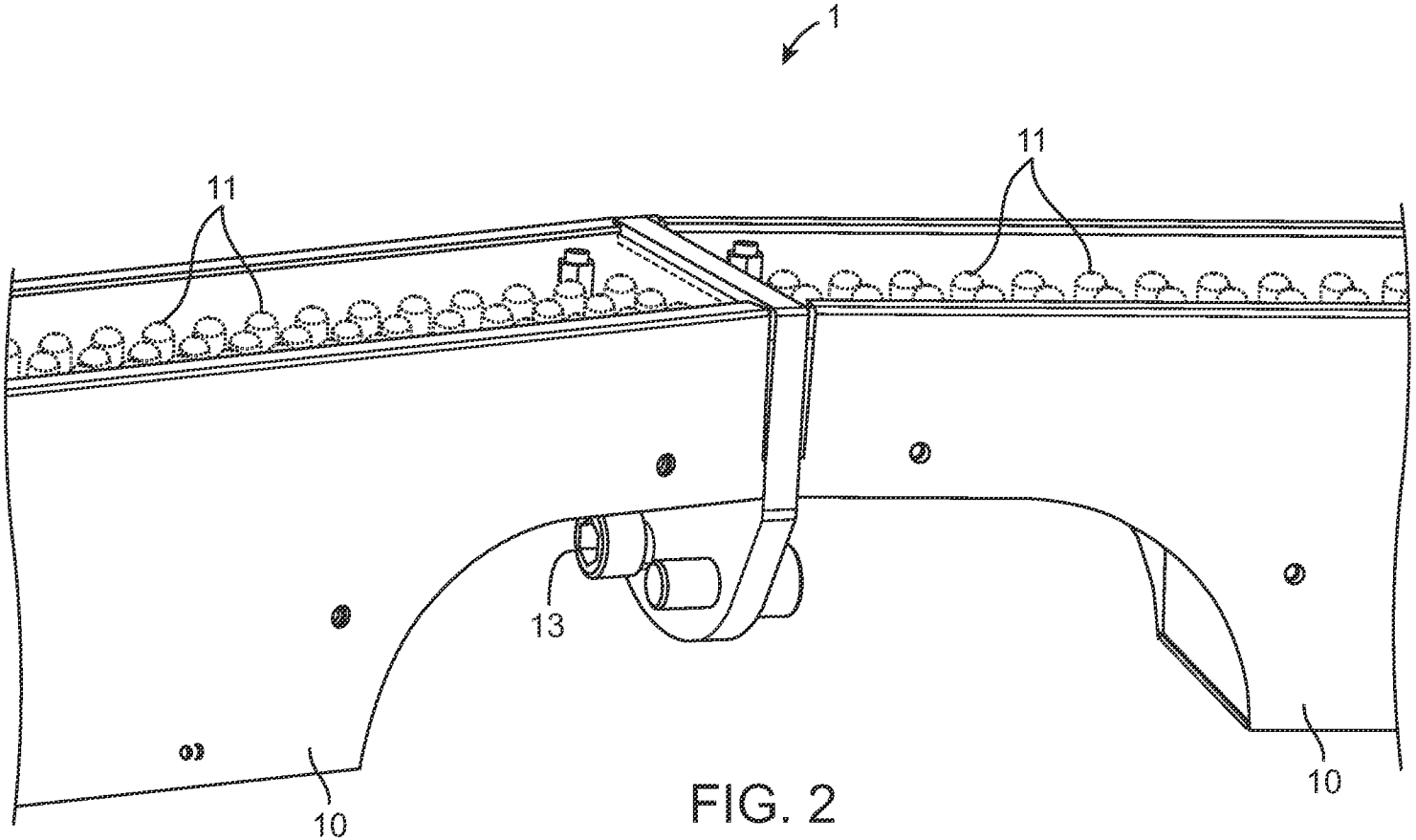
FIG. 2 shows a perspective view, illustrating lighting elements of lighting segments.

The present invention provides a modular lighting fixture system for lighting elements. Referring to FIGS. 1-2, one embodiment of such a modular lighting fixture system 1 comprises multiple modular lighting segments 10, wherein each lighting segment 10 may support multiple lighting elements 11. FIG. 1 shows a perspective view of underside of a lighting segment 10, and FIG. 2 shows a perspective view, illustrating lighting elements 11 on top of the lighting segments 10. Each lighting element 11 comprises a light source such as an incandescent bulb, light emitting diode (LED), etc.

Figure 3:
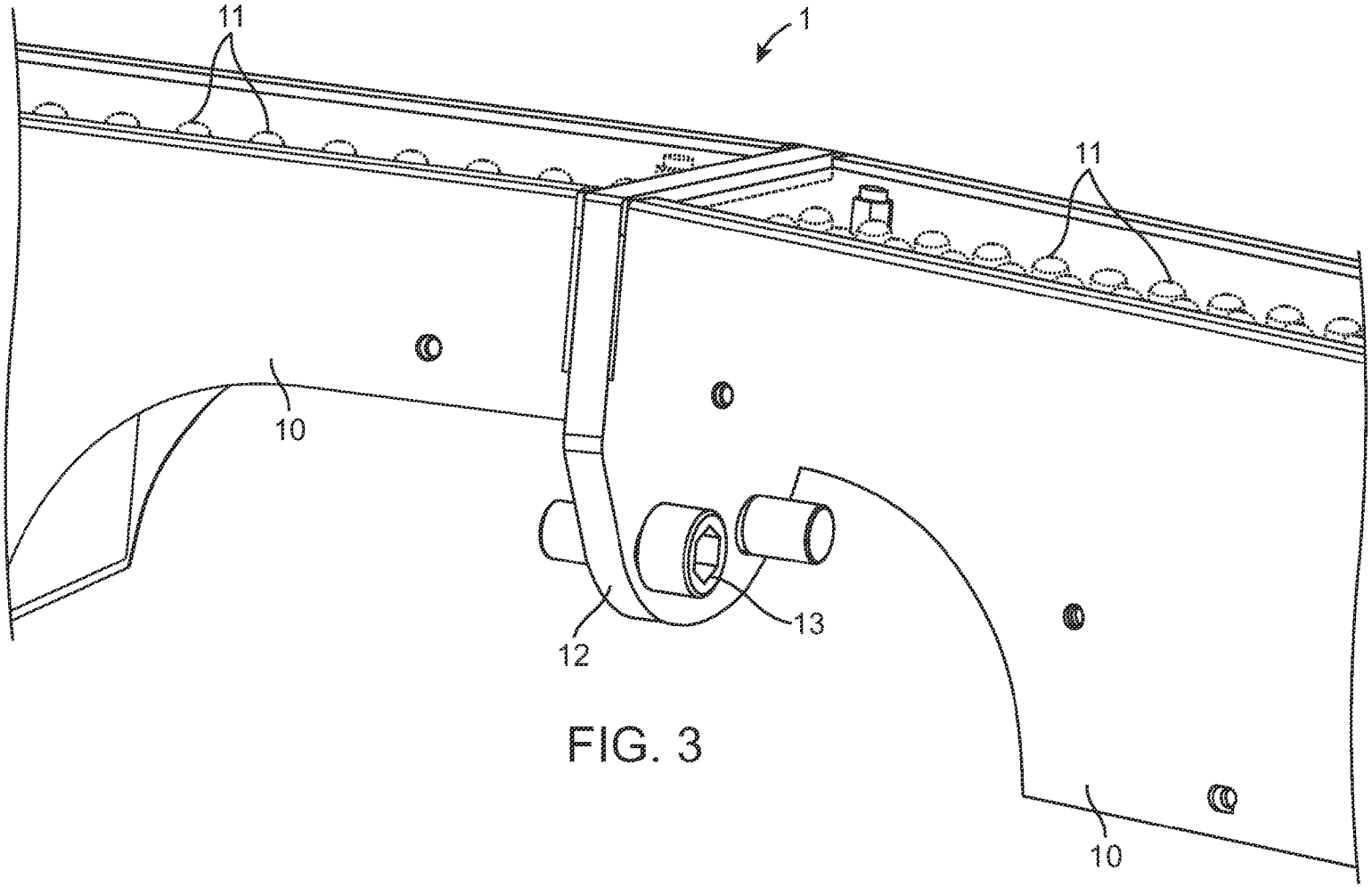
FIG. 3 shows partial views of lighting elements connected together.

In one implementation, the modular lighting segments 10 fit together as shown in FIGS. 2-3, to create different shapes and designs, forming a larger overall controlled fixture system 1. Each modular segment 10 has one of a plurality of shapes and mates with at least one other modular segment. This allows creating a larger overall controlled fixture system in a type of lighting erector set.

In the embodiments shown in the drawings, the modular lighting segments 10 comprise essentially curved segments and straight segments, which can be connected to form circles, arches, ovals, and "S shaped" configurations as an overall controlled fixture system. Other shapes can also be made by connecting the lighting segments in different ways.

Figure 4:
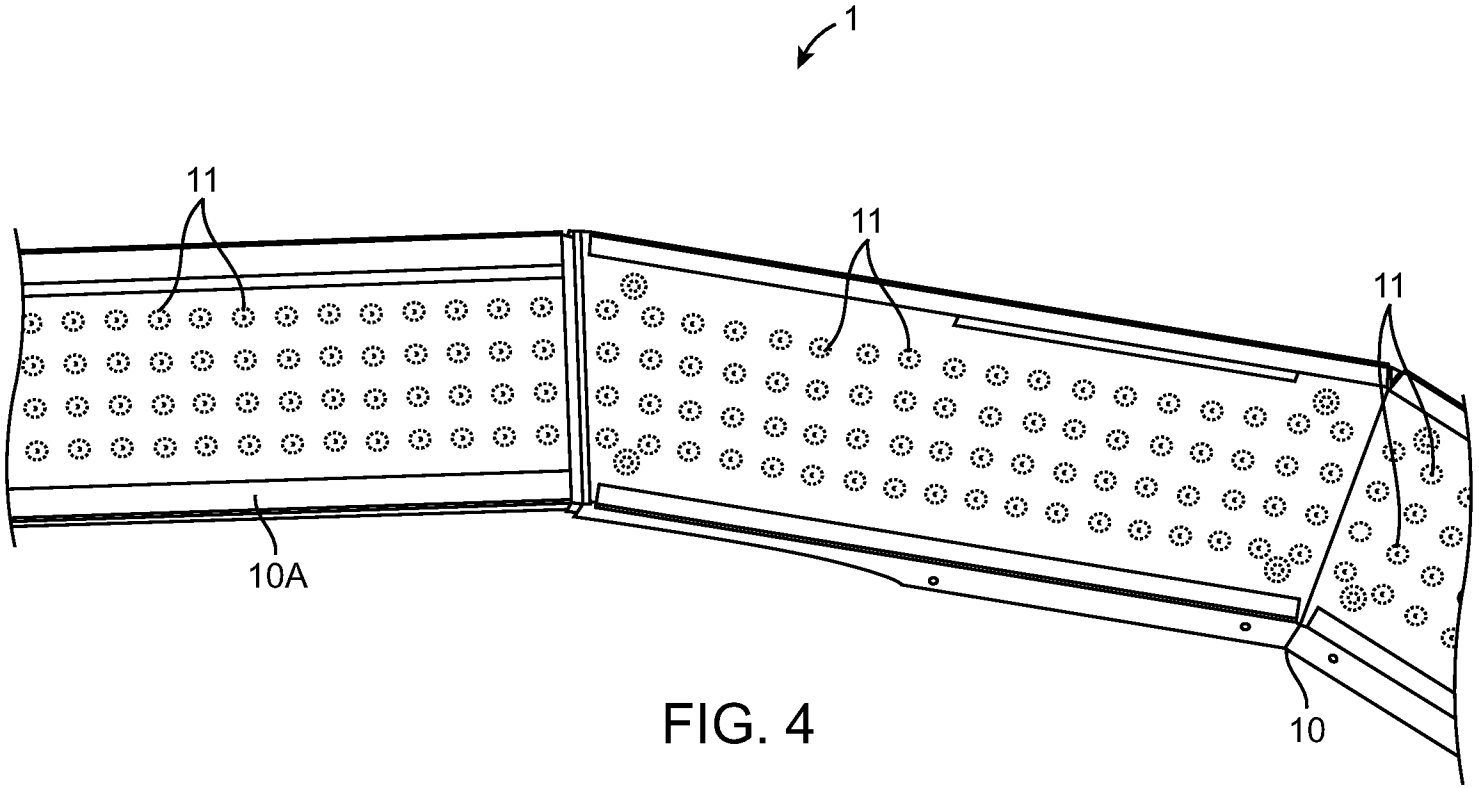
FIG. 4 shows a top view of lighting elements connected together.
Figure 5:
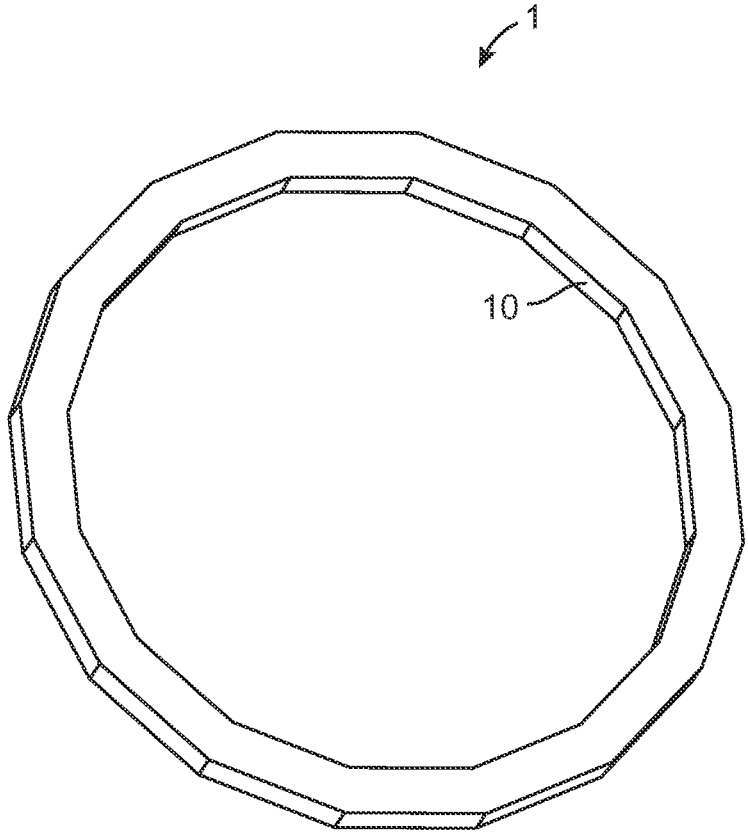
FIG. 5 shows an example overall controlled fixture system.

In a preferred embodiment of the present invention in FIG. 4, the modular segment shapes include essentially circular segments 10 (FIG. 1) extending approximately 3 feet long (28 inches from corner to corner) and about 15° around the circumference of a circle, and straight segments 10A also extending approximately 3 feet long along a straight line. The front face of the lighting segments 10 where the lighting elements 11 are exposed, is approximately 2.5 inches wide and 3 inches deep. Other sizes and shapes of the modular segments can also be envisioned to likewise expand the choices of size and shapes for an overall controlled fixture system 1 (FIG. 5).

Figure 6:
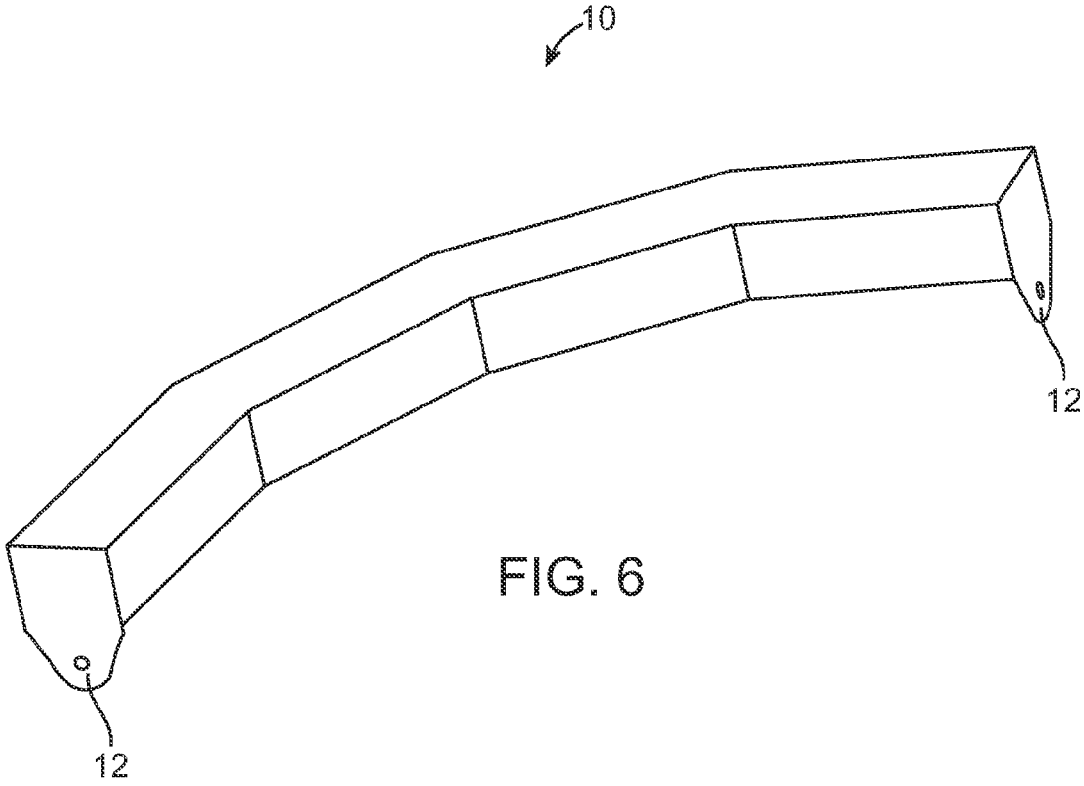
FIGS. 6-7 and show inner and outer perspectives of the underside of an example modular segment, respectively.
Figure 7:
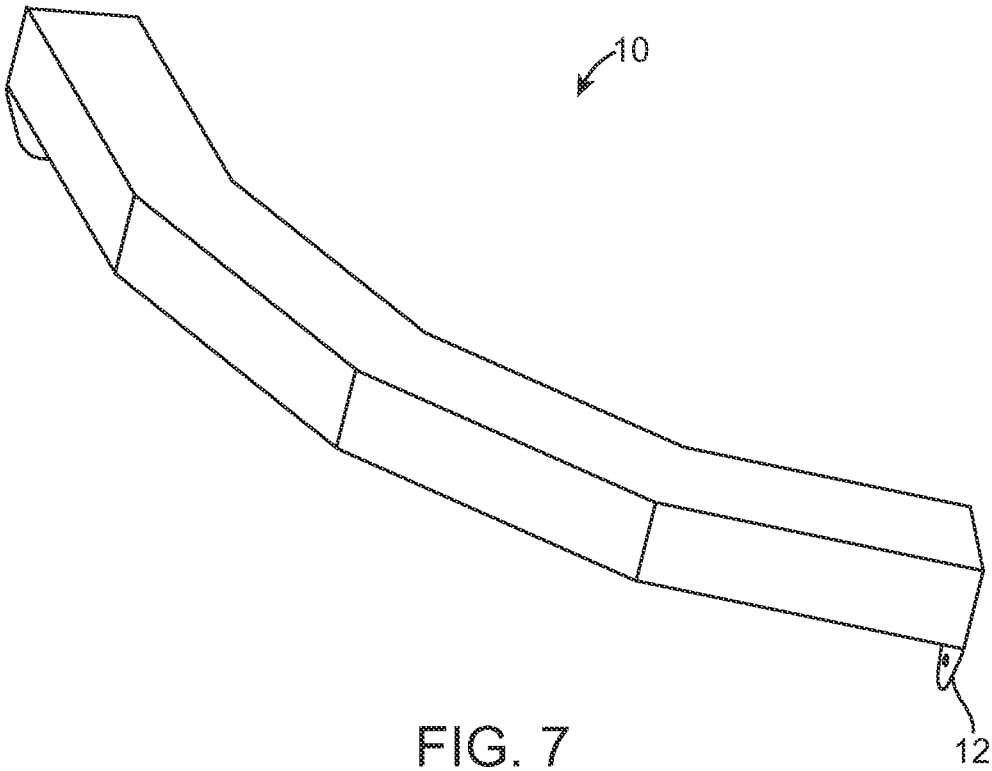

As shown in FIG. 1, the rear side (or underside) of each modular segment 10 also includes a mounting bracket 14 which allows the modular segment 10 to be affixed to a supporting surface or structure such as a wall, ceiling or truss. FIGS. 6-7 show inner and outer perspectives of the underside of a modular segment 10, respectively.

Figure 8:
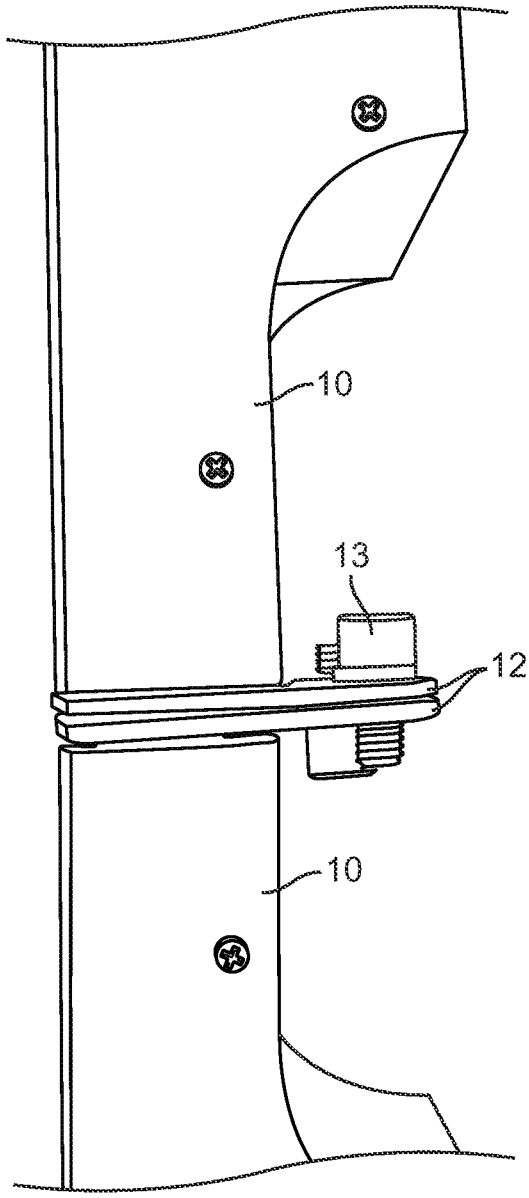
FIG. 8 shows an example mating system for fitting modular segments together.

The different modular segments utilize a mating system for mechanically fitting/connecting together using, for example, flanges 12 (FIG. 1) mounted on each end of the modular segments. The flanges 12 have through holes where screw mounts 13 (FIGS. 3, 8) can be inserted and tightened to hold the flanges 12 together, and thereby the modular segments 10, stably in place. The screws 13 also can be removed to reconfigure the mechanical mating of the modular segments 10 and thereby the overall shape of the fixture system 1. Although the preferred embodiment uses a screw and flange mating system, any type of mechanical mating system that holds the modular segments 10 in place may also be used within the scope of the present invention.

Figure 9:
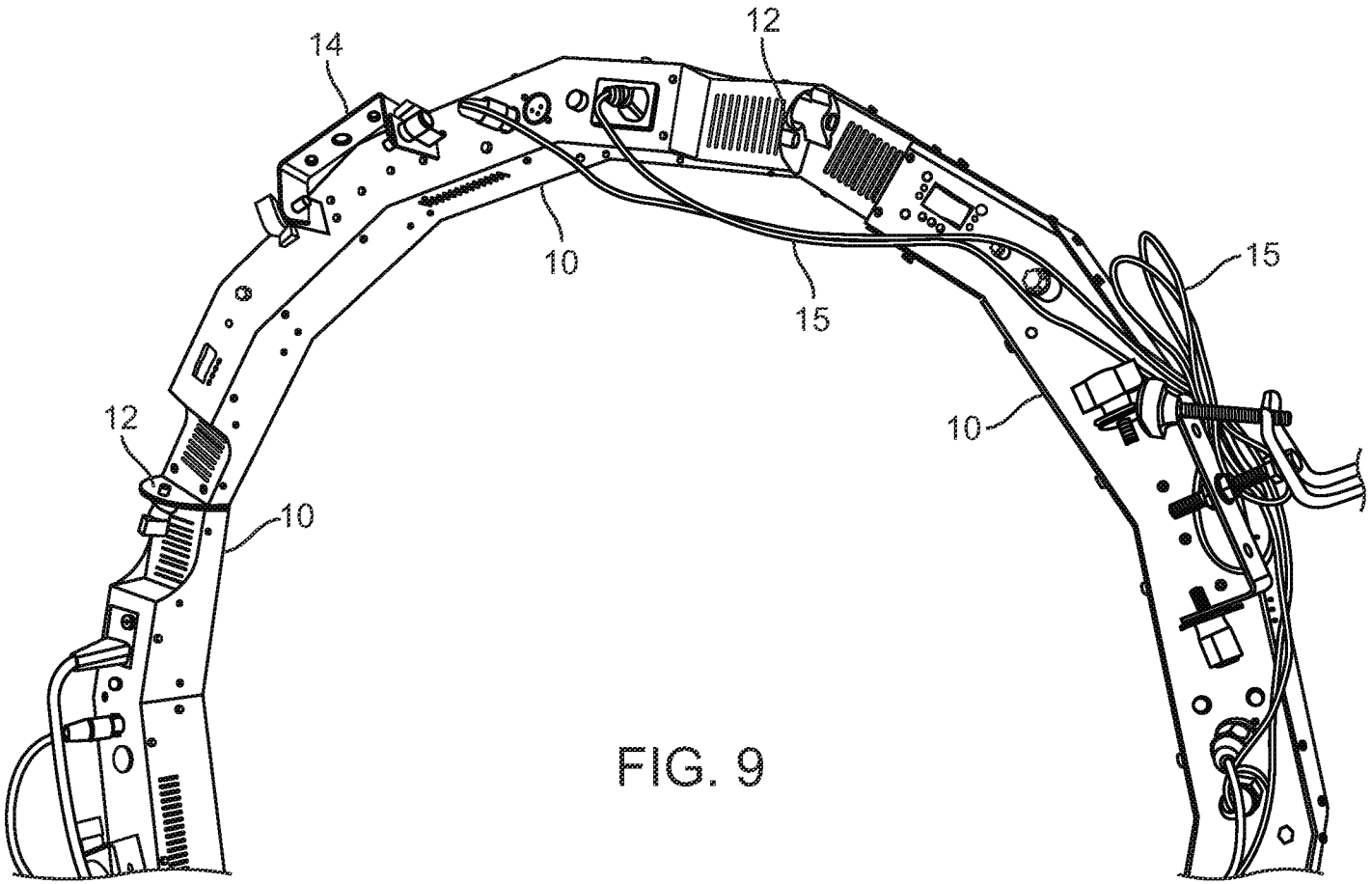
FIGS. 9-10 show example controller cable and electrical power connections for modular segments.
Figure 10:
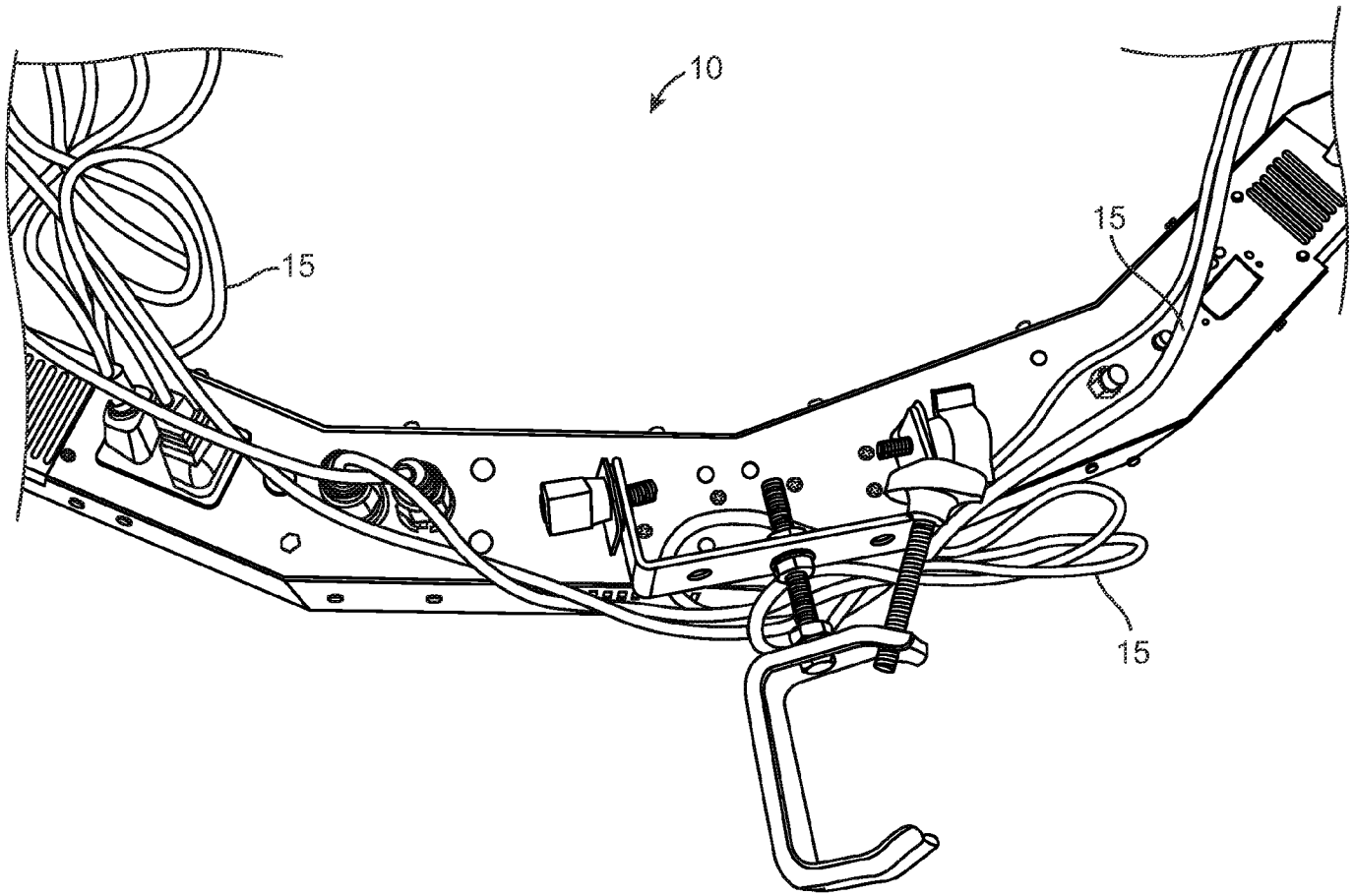
Figure 11:
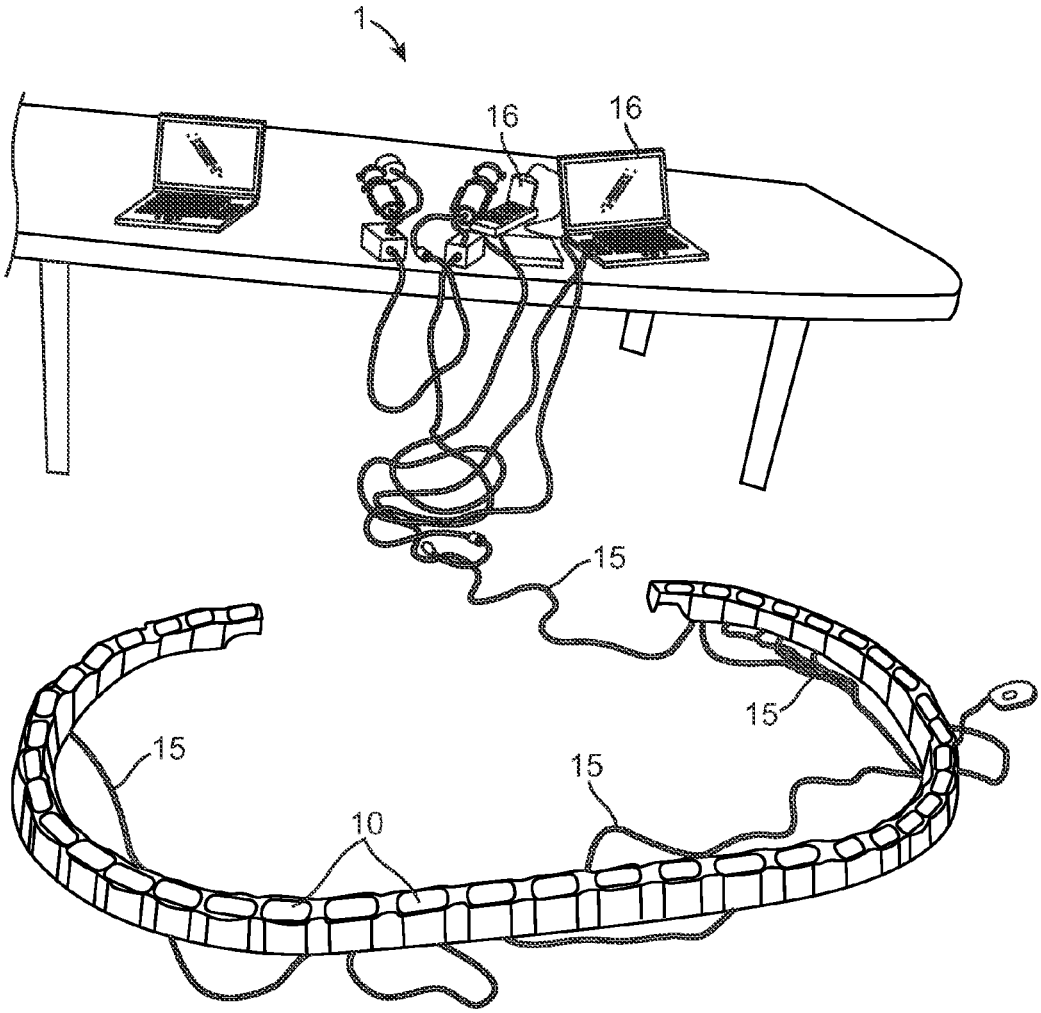
FIG. 11 shows modular lighting segments connected to form a system, and controlled by a controller.

In a preferred embodiment, each modular segment 10 includes commonly known DMX controller cable and electrical power connections 15 on the back side (FIGS. 9-10), and multi-color LEDs 11 on the front side (FIGS. 2-4). The controller and power connections 15 allow electrical power to be provided to the modular segments 10, wherein the modular segments 10 may be controlled (individually or in groups) from a single external control unit such as a DMX Controller or computer 16 (FIG. 11). The preferred embodiment is directed to multicolor LEDs, or Single Color LEDs but other types of lighting elements or lamps may also be used within the intended purpose of the invention.

The DMX Controller or computer 16 can either drive the modular segments 10 in real time or use a preloaded program. It is envisioned in other embodiments that the DMX Controller or computer can upload a control program to the modular segments to on board storage units within each modular segment. It is also envisioned that the mechanical mating system may also be modified to include an electrical docking port 17 (FIG. 1) which would eliminate or minimize the need for external cables.

Figure 13:
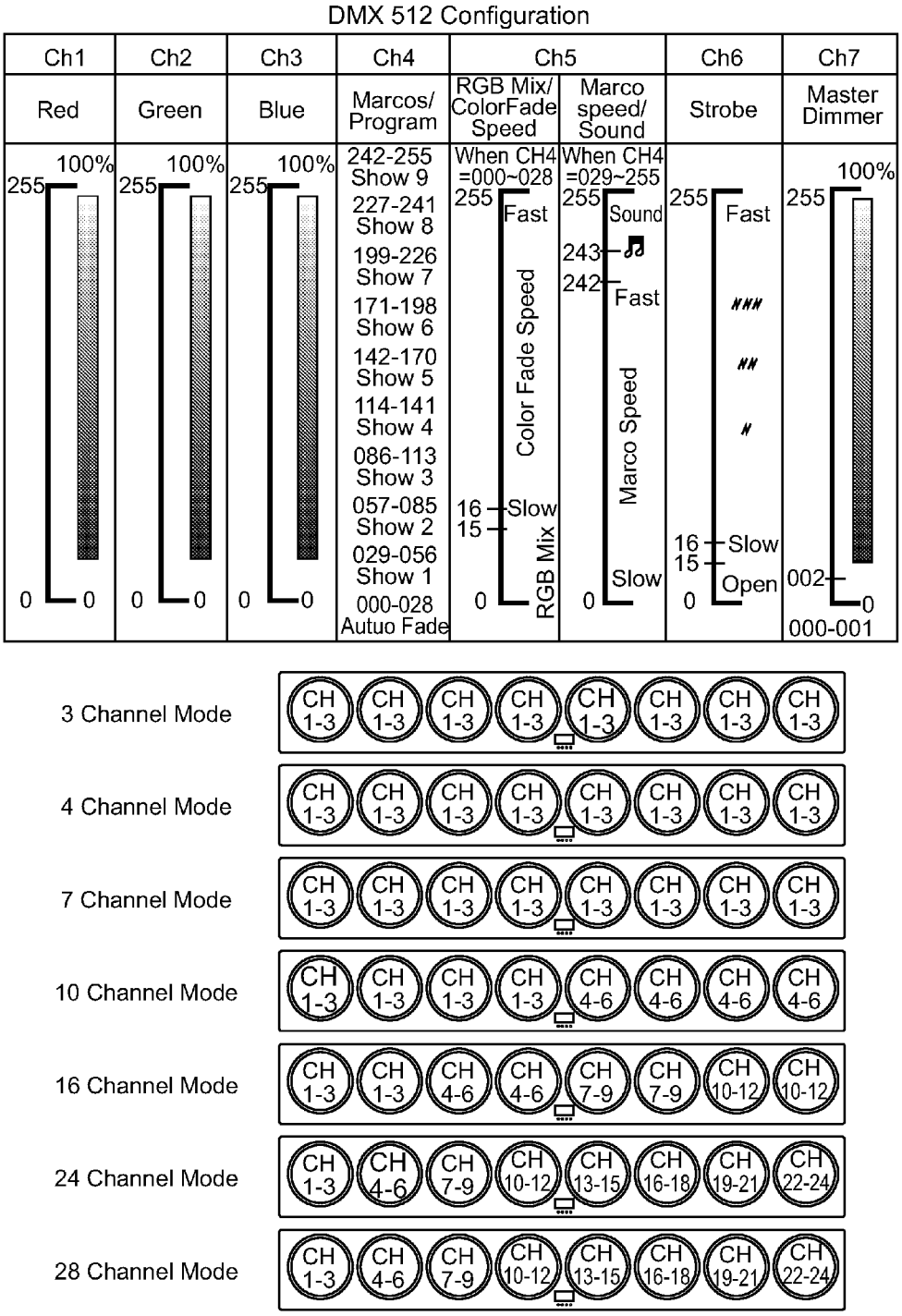
FIG. 13 shows an example DMX control configuration for various lighting element control channels.

FIG. 11 shows modular lighting segments connected to form a system, and controlled by a controller. FIG. 12 shows an example LED display menu and function for controlling the lighting elements. FIG. 13 shows an example DMX control configuration for various lighting element control channels.

As is known to those skilled in the art, the aforementioned example architectures, according to the present invention, can be implemented in many ways, such as program instructions for execution by a processor, as software modules, microcode, as computer program product on computer readable media, as logic circuits, as application specific integrated circuits, as firmware, etc. The embodiments of the invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Generally, the term "computer-readable medium", as used herein, refers to any medium that participated in providing instructions to a processor for execution. Such a medium may take many forms, including but not limited to, non-volatile media, volatile media and transmission media. Non-volatile media includes, for example, optical or magnetic disks, such as a storage device. Volatile media includes dynamic memory, such as main memory. Transmission media includes coaxial cables, copper wire and fiber optics, including the wires that comprise a bus. Transmission media can also take the form of acoustic or light waves, such as those generated during radio wave and infrared data communications.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Though the present invention has been described with reference to certain versions thereof; however, other versions are possible. Therefore, the spirit and scope of the appended claims should not be limited to the description of the preferred versions contained herein.

What is claimed is:

1. A modular lighting fixture system, comprising:

plural modular lighting segments, each individual modular lighting segment including a light source within a body of the modular lighting segment, the light source comprising a plurality of light emitting diode lighting elements;

each modular lighting segment including a mating system for mechanically connecting the modular lighting segment to another modular lighting segment;

each modular lighting segment including an onboard storage unit for receiving a control program from an external controller and controlling the modular lighting segment;

wherein the modular lighting segments couple with one another forming a plurality of different shapes and designs, and forming a larger overall integrated lighting fixture system; and each of the plurality of light emitting diode lighting elements is individually controllable.

2. The system of claim 1, wherein:

each lighting element capable of being electrically powered.

3. The system of claim 2, wherein:

each modular segment further includes controller cable and electrical power connections for providing electrical power to each lighting element; and the modular lighting segments are controllable, individually or in groups, from a single external controller.

4. The system of claim 3, wherein the electrical power connections of each segment include an electrical plug socket.

5. The system of claim 2, wherein the mating system includes an electrical docking port included in each modular lighting segment, for electrically coupling two modular lighting segments.

6. The system of claim 1, wherein a modular lighting segment includes a mounting bracket for coupling the modular lighting segment to a supporting surface or structure.

7. The system of claim 1, wherein each modular lighting segment has one of a plurality of shapes and can connect with at least one other modular lighting segment, for creating a larger overall controlled fixture system in a type of lighting erector set.

8. The system of claim 7, wherein:

the modular lighting segments comprise at least one of: essentially curved lighting segment shapes and straight lighting segment shapes; and the modular lighting segments removably couple to one another forming at least one of: circles, arches, ovals, and "S shaped" configurations, as an overall controlled fixture system.

9. The system of claim 8, wherein the modular lighting segment shapes include:

essentially circular segments extending approximately 3 feet long and about 15° around the circumference of a circle; and essentially straight segments extending approximately 3 feet long along a straight line;

such that a front face of each segment is approximately 2.5 inches wide and 3 inches deep.

10. The system of claim 1, wherein:

the modular lighting segments utilize said mating systems for mechanically connecting together, each mating system comprising a flange mounted on each end of a modular lighting segment, the flanges having through holes for inserting screw mounts, such that the screw mounts can be tightened to hold the flanges together, and thereby the modular lighting segments, stably in place.

11. The system of claim 10, wherein the screw mounts can be removed to reconfigure the mechanical mating of the modular lighting segments and thereby the overall shape of the lighting fixture system.

12. The system of claim 1, wherein the plurality of light emitting diode lighting elements comprise multi-colored light emitting diodes (LEDs).

13. The system of claim 12, wherein the plurality of lighting elements comprise a plurality of rows and columns of LEDs.

14. The system of claim 1, wherein the mating system mechanically connects the modular lighting segment to another modular lighting segment using hardware fasteners.

15. A method of forming a lighting fixture system, comprising:

providing plural modular lighting segments, each individual modular lighting segment including a light source within a body of the modular lighting segment, the light source comprising a plurality of light emitting diode lighting elements, each modular lighting segment further including a mating system for mechanically connecting the modular lighting segment to another modular lighting segment; each modular lighting segment including an onboard storage unit for receiving a control program from an external controller and controlling the modular lighting segment;

fitting the modular lighting segments together with one another for creating different shapes and designs, and forming a larger overall integrated lighting fixture system; and controlling power individually to each of the plurality of light emitting diode lighting elements.

16. The method of claim 15, wherein:

each modular segment further includes controller cable and electrical power connections allowing electrical power to be provided to each of the plurality of lighting elements; and the modular lighting segments may be controlled, individually or in groups, from a single external controller.

17. The method of claim 16 further comprising electrically coupling a DMX controller to the controller cable connections for controlling the modular lighting segments.

18. The method of claim 15, wherein the mating system includes an electrical docking port within each modular lighting segment, for electrically coupling two modular lighting segments.

19. The method of claim 15, wherein each modular lighting segment has one of a plurality of shapes and connects with at least one other modular lighting segment, for creating a larger overall controlled lighting fixture system in a type of lighting erector set.

20. The method of claim 15, wherein:

the modular lighting segments comprise at least one of: essentially curved lighting segment shapes and straight lighting segment shapes;

the modular lighting segments can be connected to form at least one of: circles, arches, ovals, and "S shaped" configurations, as an overall controlled fixture system.

21. A lighting fixture, comprising:

a modular lighting segment including a mating system for mechanically connecting the modular lighting segment to another modular lighting segment, wherein the modular lighting segments fit together to create different shapes and designs, forming a larger overall integrated fixture system; each modular lighting segment including an onboard storage unit for receiving a control program from an external controller and controlling the modular lighting segment; and the modular lighting segment further including a lighting source within a body, the lighting source comprising a plurality of light emitting diode lighting elements that are each individually controllable and capable of being electrically powered individually.

22. The lighting fixture of claim 21, wherein:

the modular lighting segment further includes controller cable and electrical power connections providing electrical power to each lighting element; and the modular lighting segment is controllable from a single external controller.

23. The lighting fixture of claim 21, wherein the mating system includes an electrical docking port for the modular lighting segment, for electrically coupling two modular lighting segments.

24. The lighting fixture of claim 21, wherein the modular lighting segment includes a hardware mounting bracket which allows the modular lighting segment to be affixed to a supporting surface or structure.

25. The lighting fixture of claim 21, wherein the modular lighting segment has one of a plurality of shapes and can connect with at least one other modular lighting segment, for creating a larger overall controlled fixture system in a type of lighting erector set.

26. The lighting fixture of claim 25, wherein:

the modular lighting segment comprises one of: essentially curved lighting segment shape and straight lighting segment shape;

the modular lighting segment connects with another modular lighting segment forming at least one of: circles, arches, ovals, and "S shaped" configurations, as an overall controlled fixture system.

27. The lighting fixture of claim 26, wherein the modular lighting segment shapes include one of:

essentially circular segments extending approximately 3 feet long and about 15° around the circumference of a circle;

essentially straight segments extending approximately 3 feet long along a straight line;

such that a front face of the modular lighting segment is approximately 2.5 inches wide and 3 inches deep.

28. The lighting fixture of claim 21, wherein:

the modular lighting segment utilizes said mating systems for mechanically connecting to another modular lighting segment, the mating system comprising a flange mounted on each end of the modular lighting segment, the flanges having through holes for inserting screw mounts, such that the screw mounts hold the flanges together for attaching plural modular lighting segments together stably in place.

29. The lighting fixture of claim 28, wherein the screw mounts are removable for reconfiguring the mechanical mating of the modular lighting segments and the overall shape of the fixture.

* * * * *